US012012947B2

(12) United States Patent
Alfayad et al.

(10) Patent No.: US 12,012,947 B2
(45) Date of Patent: Jun. 18, 2024

(54) HYDRAULIC ACTUATOR WITH OVERPRESSURE COMPENSATION

(71) Applicant: UNIVERSITE DE VERSAILLES SAINT-QUENTIN-EN-YVELINES, Versailles (FR)

(72) Inventors: Samer Alfayad, Cachan (FR); Mohamad Kardofaki, Velizy (FR); Maya Sleiman, Velizy (FR)

(73) Assignee: UNIVERSITE DE VERSAILLES SAINT-QUENTIN-EN-YVELINES, Versailles (FR)

( * ) Notice: Subject to any disclaimer, the term of this patent is extended or adjusted under 35 U.S.C. 154(b) by 320 days.

(21) Appl. No.: 17/431,153

(22) PCT Filed: Feb. 25, 2020

(86) PCT No.: PCT/EP2020/054895

§ 371 (c)(1),
(2) Date: Aug. 14, 2021

(87) PCT Pub. No.: WO2020/173933

PCT Pub. Date: Sep. 3, 2020

(65) Prior Publication Data

US 2022/0145868 A1 May 12, 2022

(30) Foreign Application Priority Data

Feb. 25, 2019 (FR) ..... 1901923

(51) Int. Cl.
*F04B 1/32* (2020.01)
*F04B 49/08* (2006.01)

(52) U.S. Cl.
CPC ..... *F04B 1/32* (2013.01); *F04B 49/08* (2013.01); *F04B 2203/0605* (2013.01)

(58) Field of Classification Search
CPC .. F04B 1/32; F04B 1/322; F04B 1/324; F04B 49/08
See application file for complete search history.

(56) References Cited

U.S. PATENT DOCUMENTS 4,456,434 A * 6/1984 El Ibiary ..... F04B 49/002 60/389
4,723,892 A * 2/1988 Cowan ..... F04B 1/324 417/222.1

(Continued)

FOREIGN PATENT DOCUMENTS

CA 1 301 543 C 5/1992
DE 197 58 012 A1 7/1998

(Continued)

OTHER PUBLICATIONS

FR2965311A1_t machine translation thereof (Year: 2012).*

(Continued)

*Primary Examiner* — Kenneth Bomberg
*Assistant Examiner* — Matthew Wiblin
(74) *Attorney, Agent, or Firm* — BakerHostetler

(57) ABSTRACT

A hydraulic actuator includes a variable-delivery positive-displacement pump, a member able to continuously vary the delivery of the pump, the member being actuated by a ram supplied by a first directional-control valve commanded on the basis of an actuator movement instruction. The actuator comprises a second directional-control valve commanded on the basis of an output pressure of the pump, the second directional-control valve comprising two positions, one of them, known as the rest position, obtained as long as the output pressure of the pump is below a predetermined pressure and transmitting the output from the first directional-control valve to the double-acting ram and the other, referred to as the active position, transmitting the output (Continued)

pressure of the pump to the ram so as to reduce the output pressure of the pump without passing via the first directional-control valve.

10 Claims, 3 Drawing Sheets

(56) References Cited

U.S. PATENT DOCUMENTS

| | | | | |
|---|---|---|---|---|
| 4,729,717 | A * | 3/1988 | Gupta | F04B 1/22 417/410.1 |
| 4,750,866 | A | 6/1988 | Entwistle | |
| 6,105,367 | A * | 8/2000 | Tsuruga | F15B 11/165 60/449 |
| 8,734,123 | B2 | 5/2014 | Alfayad et al. | |
| 10,954,927 | B2 | 3/2021 | Kharpas et al. | |
| 2018/0149150 | A1* | 5/2018 | Lettini | F04B 49/002 |
| 2020/0158140 | A1* | 5/2020 | Orth | F15B 15/18 |

FOREIGN PATENT DOCUMENTS

| | | | | |
|---|---|---|---|---|
| DE | 10 2008 038 435 | A1 | 2/2009 | |
| EP | 0 879 968 | A1 | 11/1998 | |
| FR | 2965311 | A1 * | 3/2012 | F03C 1/0647 |
| JP | S58-156186 | U | 10/1983 | |
| JP | 62-168973 | A | 7/1987 | |
| JP | 10-331773 | A | 12/1998 | |
| JP | 2018-533692 | A | 11/2018 | |
| WO | 2017/083839 | A1 | 5/2017 | |

OTHER PUBLICATIONS

Notice of Reasons for Rejection issued in Japanese Patent Application No. 2021-549131 dated Feb. 6, 2024, with English translation.

* cited by examiner

HYDRAULIC ACTUATOR WITH OVERPRESSURE COMPENSATION

CROSS-REFERENCE TO RELATED APPLICATIONS

This application is a National Stage of International patent application PCT/EP2020/054895, filed on Feb. 25, 2020, which claims priority to foreign French patent application No. FR 1901923, filed on Feb. 25, 2019, the disclosures of which are incorporated by reference in their entirety.

FIELD OF THE INVENTION

The invention relates to a hydraulic actuator. This type of actuator is widely used for maneuvering mobile elements. The use of hydraulic energy offers an advantage over electrical energy because of its very good ratio between the delivered power and the mass of the actuator. Another advantage likewise lies in a very good ratio between the delivered power and the volume of the actuator.

BACKGROUND

In addition, actuators that employ electric motors are highly suitable only for high speeds and low torques. In particular applications, notably robotics, the reverse situation is frequently encountered: low speed and high torque. The use of electric motors for low speeds entails significant reduction ratios which are therefore complicated to achieve with a fixed and limited reduction ratio.

Furthermore, in the use of any actuator, be it hydraulic or electrical, it is often necessary to provide for limiting the load or the speed exerted by the actuator. Limitation may be achieved by means of an actuator control loop comprising a sensor that measures the load or the speed, the sensor being associated with a controller allowing the commanding of the actuator to be modulated according to an output signal from the sensor and a load or speed set point that must not be exceeded.

This type of limitation is often linked with the operational safety of the actuator and is associated with undesired events, notably for protecting the surroundings of the actuator. This type of limitation also allows the actuator to be protected from external attack.

It is possible to incorporate this type of limitation into an operational control loop. For example, when the operation of the actuator requires the feedback control over the angular position of a rotor of the actuator, it is possible to benefit from the presence of the operational feedback-control loop to incorporate a safety limitation thereinto, for example in order to limit the force delivered by the actuator. However, the operating parameter and the safety parameter are often different, with different requirements in terms of response time, stability and the like, and it is then necessary to provide two sensors, one for each of the parameters.

Furthermore, in the case of open-loop operation, it would be necessary to provide a control loop solely for controlling the safety parameter.

In general, the operational and/or safety control loop has numerous disadvantages. First of all, the sequence connecting the quantity that is to be measured and the commanding of the actuator is long, and this has a tendency to increase the response time. This may prove problematical in responding to unforeseen and instantaneous loadings such as impacts. In addition, the number of components required to produce the control loop often leads to deterioration of the reliability of the actuator. In addition, in the case of a safety loop designed to guard against an impact, it is necessary to situate the impact sensor as close as possible to the zone liable to suffer the impact. This zone is often distant from the actuator, thereby lengthening the path taken by the information between the sensor and the actuator. This lengthening reduces the responsiveness of the actuator in the face of an impact. In addition, the length of the path has a tendency to reduce the reliability of the safety loop.

SUMMARY OF THE INVENTION

The invention seeks to overcome all or some of the problems mentioned hereinabove by proposing a hydraulic actuator able to dispense with the control loop for guarding against the effects of an overpressure arising, the overpressure generally being associated with too high a force, for example associated with an impact.

The invention makes it possible to reduce the response time of the actuator in the event of abnormal operation, without impairing the reliability thereof.

To this end, the subject of the invention is a hydraulic actuator comprising a variable-delivery positive-displacement pump, a first directional-control valve commanded on the basis of an actuator movement instruction, and a ram supplied by the first directional-control valve, the pump comprising a mobile member a movement of which allows the delivery of the pump to be continuously varied, the member being able to be moved by the ram, the first directional-control valve being able to apply a continuous function linking the movement instruction to the delivery of the pump via the position of the member as it moves. According to the invention, the actuator comprises a second directional-control valve commanded on the basis of an output pressure of the pump, the second directional-control valve comprising two positions, one of them, known as the rest position, obtained as long as the output pressure of the pump is below a predetermined pressure and transmitting the output from the first directional-control valve directly to the double-acting ram, thereby allowing the pump to follow the continuous function and the other, referred to as the active position, obtained when the output pressure of the pump is greater than or equal to the predetermined pressure and transmitting the output pressure of the pump to the ram so as to reduce the output pressure of the pump without passing via the first directional-control valve and without following the continuous function.

Advantageously, the predetermined pressure is adjustable.

The member may be configured to allow the pump to reverse the direction of its delivery.

Advantageously, the ram comprises two chambers. The actuator then comprises a third directional-control valve configured to transmit the output pressure of the pump either to one or the other of the two chambers according to the direction of the delivery of the pump.

The hydraulic actuator advantageously further comprises a set of valves which is configured to command the second directional-control valve by means of the highest output pressure of the pump.

The ram advantageously comprises a mobile rod connected to a body of the first directional-control valve.

The mobile rod may be connected to the body of the first directional-control valve by means of an encastre connection.

The pump may be a piston pump with axial pistons, the member allowing the delivery to be varied being a swashplate with variable inclination against which the pistons press, varying the inclination of the swashplate allowing the stroke of the pistons to be varied, the inclination of the swashplate being adjusted by the ram driven by a microactuator defining the actuator instruction through the first directional-control valve as long as the output pressure of the pump is below a predetermined pressure.

The hydraulic actuator advantageously comprises a casing inside which are arranged: the pump, a motor allowing actuation of the pump, the member allowing the delivery of the pump to be continuously varied, the ram actuating the member, the first directional-control valve supplying the ram, a microactuator maneuvering the first directional-control valve and the second directional-control valve. The actuator further comprises at least one electrical connector passing through the casing and allowing the actuator to receive electrical energy that powers the motor and an electrical signal which drives the microactuator, and a hydraulic connector passing through the casing and allowing the actuator to deliver hydraulic energy.

Alternatively, the hydraulic actuator advantageously comprises a casing inside which are arranged: the pump, a motor allowing actuation of the pump, the member allowing the delivery of the pump to be continuously varied, the ram actuating the member, the first directional-control valve supplying the ram, a microactuator maneuvering the first directional-control valve and the second directional-control valve. The actuator further comprises at least one electrical connector passing through the casing and allowing the actuator to receive electrical energy that powers the motor and an electrical signal which drives the microactuator, and a mechanical output passing through the casing and allowing the actuator to deliver mechanical energy.

The electrical connector advantageously allows the actuator to receive a second electrical signal to drive the adjustment of the predetermined pressure.

The first directional-control valve may comprise a neutral position in which the member is immobile, not causing the delivery of the pump to vary, and two active positions in which the member moves, causing the delivery of the pump to vary. The directional-control valve is advantageously configured in such a way that the transition between the neutral position and one of the active positions takes place continuously.

BRIEF DESCRIPTION OF THE DRAWINGS

The invention will be better understood and further advantages will become apparent from reading the detailed description of one embodiment given purely by way of example, the description being illustrated by the attached drawings in which.

For the sake of clarity, the same elements will bear the same references in the various figures.

DETAILED DESCRIPTION

There are different types of variable-delivery positive-displacement pump that can be employed in an actuator according to the invention.

A first type of pump, referred to as a radial-pistons pump, comprises a shaft driven in rotation about an axis, a hub having a cylindrical bore and pistons able to move in radial cylinders made in the shaft. The pistons slide over the interior surface of the bore. Eccentricity between the axis of the shaft and that of the bore allows the pistons to move in their cylinder. In this type of pump, it is the movement of the pistons in their cylinder that drives the fluid. The delivery of the pump can be modified by adjusting the eccentricity.

A second type of pump, referred to as a vane pump, likewise employs an eccentric shaft rotating in the bore of a hub. The pistons are replaced by sliding vanes that slide on the interior surface of the bore. Eccentricity between the shaft and the bore causes the volume situated between two vanes either to increase, causing fluid to be admitted between two vanes, or to decrease, causing the fluid to be expelled. Here again, the pump delivery can be modified by adjusting the eccentricity.

A third type of pump, referred to as an axial-pistons pump also allows a fluid delivery to be varied continuously. This type of pump likewise comprises a shaft driven in rotation about an axis. Cylinders parallel to the axis are made in the shaft. Pistons move in the cylinders. The pump also comprises a swashplate that is inclined with respect to a plane perpendicular to the axis of rotation of the shaft. The pitons press against the swashplate. The inclination of the swashplate allows the pistons to move in their cylinder. The pump delivery can be modified by adjusting the inclination of the swashplate.

In general, the movement of a mobile member of the pump modifies the delivery thereof. In the example of a radial-pistons pump or of a vane pump, the mobile member is secured to the shaft and the movement of the member is a translational movement perpendicular to the axis of the bore so as to modify the eccentricity of the pump. In the example of an axial-pistons pump, the swashplate forms the mobile member and the movement of the member is an angular movement of the swashplate with respect to a plane perpendicular to the axis of rotation of the shaft. In the various variable-delivery positive-displacement pumps. the pump delivery is dependent on the position of the member and moving the member provides continuous modification of the delivery of the pump. It is thus possible to define a continuous function linking an actuator movement instruction or setpoint to the delivery of the pump via the position of the member when it moves. This continuous function may be a linear function, namely one defined by a proportionality coefficient. Alternatively, the function may follow a non-linear curve, provided that the function remains continuous, which is to say involves no step change.

Figure 1:
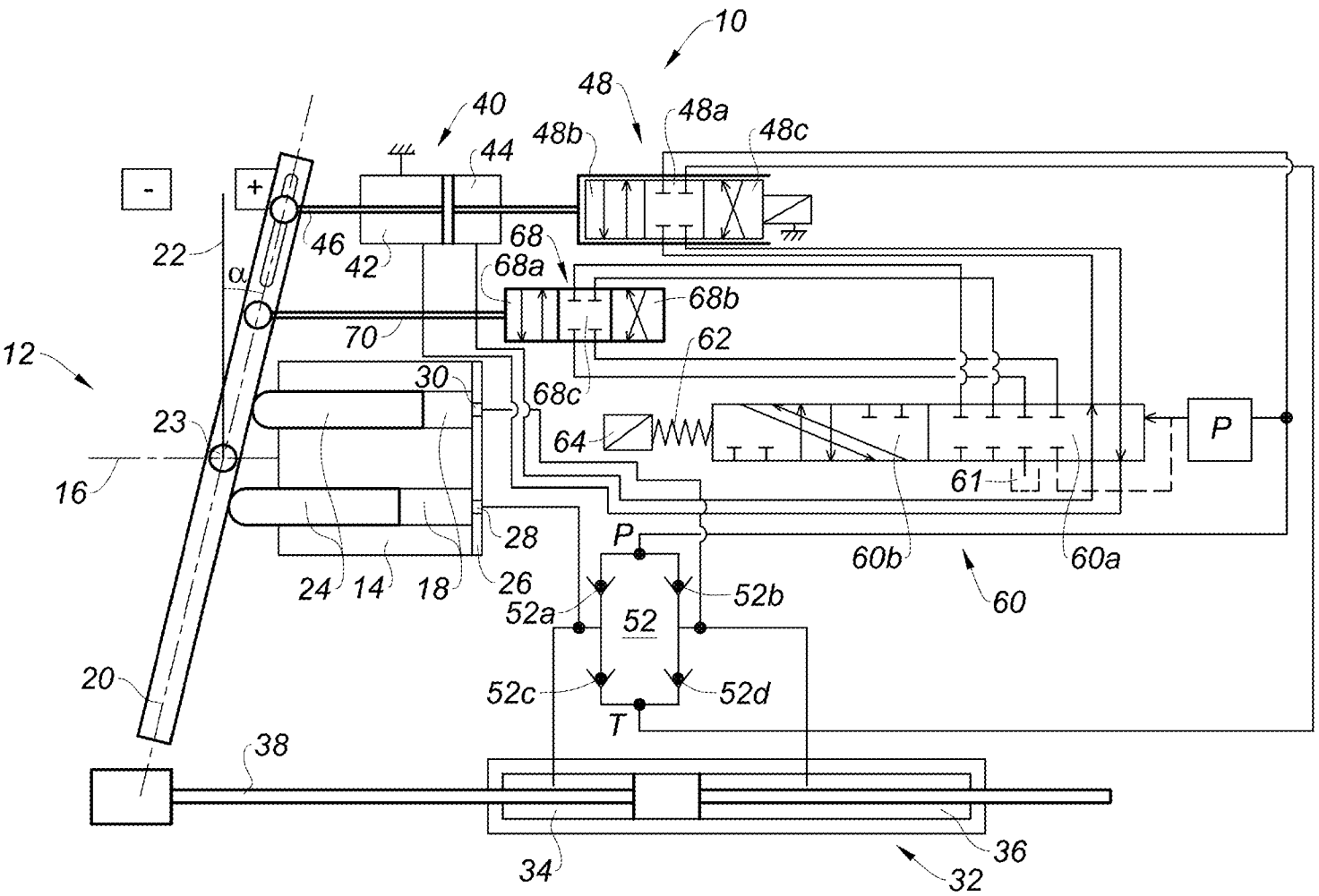
FIG. 1 depicts, in the form of a hydraulic diagram, one example of an actuator according to the invention.

FIG. 1 depicts, in the form of a hydraulic diagram, an example of an actuator 10 comprising an axial-pistons pump. As stated above, it is possible to implement the invention with any type of variable-delivery positive-displacement pump.

The actuator 10 comprises an axial-pistons pump 12 comprising a shaft 14 driven in rotation about an axis 16 by a motor which has not been depicted in FIG. 1. Several cylinders 18 extending parallel to the axis 16 are made in the shaft 14. The pump 12 comprises a swashplate 20 that can be inclined with respect to a plane 22 perpendicular to the axis 16. An inclination $\alpha$ of the swashplate 20 is defined about an axis 23 perpendicular to the axis 16. The swashplate 20 is capable of rotational movement about the axis 23 so that the inclination $\alpha$ can be varied. A zero inclination $\alpha$ of the swashplate 20 is defined as being when this swashplate is perpendicular to the axis 16, namely when the swashplate 20 extends in the plane 22. Pistons 24 may move in their respective cylinder 18. The pistons 24 press against the swashplate 20. The swashplate 20 forms a member allowing the delivery of the pump 12 to be varied continuously by varying the inclination α of the swashplate 20 with respect to the plane 22. The swashplate 20 does not rotate with the shaft 14. When the swashplate 20 is perpendicular to the axis 16, the pistons 24 do not move in their cylinder 18 and the delivery of the pump 12 is zero. By contrast, when the inclination α of the swashplate 20 is non-zero the pistons move in their cylinder 18 and perform a substantially sinusoidal reciprocating cycle over one revolution of the shaft 14. This cycle of movement allows the pump 12 to displace fluid.

The pump 12 comprises a fixed end plate 26 against which the shaft 14 bears. The end plate comprises two orifices 28 and 30 passing through the end plate 26 opposite the cylinders 18 and each substantially half-moon shaped. When the piston or pistons 24 facing one of the orifices move away from the end plate 26 as the shaft 14 rotates, this orifice forms an inlet orifice. By contrast, when the piston or pistons 24 facing the other orifice move closer toward the end plate 26 as the shaft 14 rotates, this orifice forms a delivery orifice. A change in sign of the inclination α switches over the delivery and the inlet of the pump 12. Alternatively, in order to reverse the flow passing through the orifices 28 and 30, it is possible to keep the same sign for the inclination α but reverse the rotation of the shaft 14 about the axis 16.

The actuator 10 comprises a ram 32 forming the mechanical output of the actuator 10. More specifically, the actuator receives energy, for example in electrical form, to cause the shaft 14 to rotate, for example via an electric motor, and delivers mechanical energy by means of the ram 32. In FIG. 1, the ram 32 is a linear ram. A rotary ram could of course replace this. The ram 32 comprises two chambers 34 and 36, each connected to the one of the orifices, respectively connected to the orifice 28 and to the orifice 30. A difference in pressure between the two orifices 28 and 30, obtained by means of a non-zero inclination α, allows the rod 38 of the ram 32 to be moved in one direction. A change in sign of the inclination α reverses the movement of the rod 38. When the inclination α becomes zero, the pressures between the two orifices 28 and 30 equalize and the rod 38 is immobilized.

The ram 32 is a double-acting ram in the example depicted. It is also possible to employ a single-acting ram. In that case, it is possible to implement a pump 12 in which the inclination α changes sign, by connecting one of the orifices of the pump 12 to a tank. As mentioned above, it is also possible to reverse the direction of rotation of the shaft 14.

The ram 32 may be a symmetrical ram in which the hydraulic fluid in each of the chambers 34 and 36 acts on the same surface area of piston. The ram 32 is symmetrical when its rod 38 emerges from the two chambers and maintains the same cross section as depicted in FIG. 1. Alternatively, it is also possible to employ an asymmetric ram, for example when the rod 38 emerges from the ram 32 on just one side of the piston.

The swashplate 20 is moved by means of a ram 40 which, in the example depicted, is a double-acting ram. Alternatively, a single-acting ram fitted with a return spring may also be employed. A rotary ram may also be used. The ram 40 comprises two chambers 42 and 44 each supplied with fluid. A difference in fluid pressure between the two chambers 42 and 44 allows the ram 40 rod 46 connected to the swashplate 20 to move, so as to modify the swashplate inclination α.

A ram similar to the ram 40 and able to vary the eccentricity of the pump is encountered in the case of a radial-pistons or vane pump.

The ram 40 is supplied by a directional-control valve 48 commanded on the basis of an actuator 10 movement instruction. More specifically, the directional-control valve 48 is connected to two sources of fluid pressure, a high-pressure source P and a low-pressure source T. The directional-control valve 48 may adopt three positions. In a neutral position 48*a*, the directional-control valve 48 closes off access to the chambers 42 and 44 and the swashplate 20 remains immobile. Its orientation α is unchanged. In one position 48*b* the high-pressure source P is connected to the chamber 44 and the low-pressure source T is connected to the chamber 42. In the swashplate 20 positioned depicted in FIG. 1, the position 48*b* has a tendency to reduce the value of the orientation a. Conversely, in one position 48*c*, the high-pressure source P is connected to the chamber 42 and the low-pressure source T is connected to the chamber 44 and in the swashplate 20 position depicted in FIG. 1, the position 48*c* has a tendency to increase the value of the orientation α.

The high-pressure source P and low-pressure source T may be generated independently of the pump 12. However, that adds complexity to the actuator 40 which has to be supplied from external pressure sources. In order to avoid these external sources, it is advantageous to use the pump 12 to create the two pressure sources P and T. By selecting a pump 12 of which the inclination α always maintains the same sign, the orifices 28 and 30 always maintain a pressure difference in the same direction. It is thus possible to generate the high-pressure source P and low-pressure source T directly from each of the orifices 28 and 30. In order to maintain a minimum pressure at the high-pressure source P, it is possible to provide a nonreturn valve between the delivery orifice and a microtank that forms an accumulator for the high-pressure source P. The nonreturn value is rated according to the pressure desired for the high-pressure source P. Thus, the accumulator will be supplied with fluid only when the pressure at the delivery orifice is sufficient. This pressure is linked with a minimum inclination α.

By contrast, when the inclination α is liable to adopt positive and negative values, the difference in pressure between the two orifices 28 and 30 may be positive or negative. It is nevertheless desirable to generate the pressure sources P and T from the two orifices 28 and 30. To do that, the actuator 10 comprises a set of valves 52 which is configured to supply the high-pressure source P from the orifice 28 or 30 at which the higher pressure prevails, and to supply there low-pressure source T from the orifice 28 or 30 at which the lower pressure prevails. To do that, the set of valves comprises four valves of which one value 52*a* is positioned between the orifice 28 and the source P, one valve 52*b* is positioned between the orifice 30 and the source P, one valve 52*c* is positioned between the orifice 28 and the source T, and one valve 52*d* is positioned between the orifice 30 and the source T. The orientation of the four valves may be understood by analogy with an electrical circuit in which the set of valves forms a full rectifier bridge for which the AC voltage would be formed between the orifices 28 and 30 and the DC voltage would be formed between the sources P and T. The orientation of the values 52*a* to 52*d* is similar to that of the diodes of the rectifier bridge.

The actuator 10 comprises means for limiting the effects of an overpressure at the outlet of the pump 12. Such an overpressure may be due to an internal malfunctioning of the actuator or to an external event such as an effect applied to the rod 38 of the ram 32. Any other cause of overpressure may of course generate harmful effects that need to be limited. To do that, the actuator 10 comprises a second directional-control valve 60 commanded on the basis of an outlet pressure of the pump 12. The directional-control valve 60 has two positions, one of them referred to as a rest position 60*a* obtained as long as the outlet pressure of the pump 12 is below a predetermined pressure, and the other referred to as an active position 60*b* when the outlet pressure of the pump 12 is equal to or exceeds the predetermined pressure. This predetermined pressure forms a pressure limit below which the actuator 10 operates normally. In the rest position 60*a*, the directional-control valve 60 transmits the outlet pressures directly from the directional-control valve 48 to the chambers of the ram 40. When the outlet pressure of the pump 12 reaches or tends to exceed the predetermined pressure, in the active position 60*b*, the directional-control valve 60 transmits the high outlet pressure of the pump 12 to one of the chambers 42 or 44 of the ram 40 so as to reduce the inclination α of the swashplate 20 in order to reduce the outlet pressure of the pump 12. In practice, it is the high-pressure source P that is connected to one of the two chambers without passing via the directional-control valve 48. The other chamber may be connected to the low-pressure source T or to a sump 61 as depicted in FIG. 1. The sump 61 is at atmospheric pressure. In practice, the low pressure T is substantially equal to atmospheric pressure.

When the output pressure of the pump 12 drops below the predetermined pressure value, the directional-control valve 60 returns to the rest position 60*a* and the directional-control valve 48 once again commands the ram 40 directly. The transition of the directional-control valve 60 between its two positions 60*a* and 60*b* is commanded by the output pressure of the pump 12.

In the event of overpressure, the directional-control valve 60 bypasses the directional-control valve 48. In other words, the high pressure P is connected to the ram 40 in such a way as to reduce the high pressure P when the output pressure P of the pump 12 is greater than or equal to the predetermined pressure. The continuous function connecting the actuator 10 movement instruction to the delivery of the pump via the directional-control valve 48 is deactivated. This continuous function represents nominal operation of the actuator 10. The deactivation of the function occurs in the event of an overpressure connected with abnormal operation of the actuator 10. By implementing the invention, deactivation of the continuous function by bypassing the directional-control valve 48 avoids the need to fit a pressure sensor to measure the output pressure of the pump 12 in order to detect an overpressure. Such a pressure sensor could act on the commanding of the directional-control valve 48. The invention, by bypassing the directional-control valve 48, allows the pump 12 to react far more rapidly.

It is advantageous to use the pressure source P to command the directional-control valve 60 directly. Without the use of a pressure sensor, the response of the actuator 10 to an overpressure is rapid. The only intermediary in this response is the change in position of the directional-control valve 60.

The value of the predetermined pressure beyond which the directional-control valve 60 changes position can be fixed and determined during the design of the actuator 10. To do that, the directional-control valve 60 comprises a mobile slide pushed by a spring 62. As long as the pressure P is below the predetermined pressure, the spring 62 is rated to push the slide in such a way as to keep the directional-control valve 60 in the rest position 60*a*. When the pressure P reaches or exceeds the predetermined pressure, the commanding of the directional-control valve 60, which is performed through the pressure P, is able to compress the spring 62, tending to move the slide in order to reach the active position 60*b*. The rating of the spring 62 may be set during the design of the actuator 10.

It is possible to provide for adjustment of the predetermined pressure by providing the possibility of modifying the rating of the spring 62. The spring rating may be adjusted manually, for example by means of a screw that allows the length of the spring 62 to be modified. The screw is advantageously accessible from outside the actuator 10 so that an operator can make the adjustment. It is also possible to motorize the adjustment so as to use a command, for example an electrical command, to adjust the predetermined pressure. To do that, it is possible to provide a stepping motor 64 that turns the screw. A linear motor may also act directly on the spring 62. In addition to the spring 62, it is possible to add other mechanical components, notably a damper in order to introduce a time constant into the response of the directional-control valve 60 upon the appearance of an overpressure. It is thus possible to filter out certain overpressures which are adjudged to be too brief.

In the swashplate 20 position as depicted in FIG. 1, in which for example the inclination α is considered to be positive, in the event of overpressure, the directional-control valve 60 allows the chamber 44 to be supplied from the source P so as to reduce the inclination α in order to bring the swashplate 20 closer to the plane 22. In other words, the rod 46 of the ram 40 moves to the left in the depiction of FIG. 1. Conversely, when the inclination α is negative, in the event of an overpressure, it is necessary to supply the chamber 42 from the source P so as to move the rod 46 to the right. More generally, in the event of overpressure, it is necessary to reduce the stroke of the pistons 24. In other words, in the event of an overpressure, it is necessary to reduce, in terms of absolute value, the value of the inclination α. The choice of which chamber 42 or 44 to supply in order to move the swashplate 20 in either one direction or the other may be obtained automatically using a third directional-control valve 68 commanded by the inclination α. The directional-control valve 68 allows either the chamber 44 to be supplied from the high-pressure source P and the chamber 42 to be connected to the sump 61, or the supply of the two chambers to be reversed according to the sign of the inclination α. The directional-control valve 68 comprises at least two positions: 68*a* without reversal and 68*b* with reversal. The directional-control valve 68 may comprise a middle third position 68*c* in which the supply circuits for both chambers 42 and 44 are open. This position corresponds to a zero value for the inclination α. The directional-control valve 68 is commanded by the value of the inclination α. To do that, the commanding of the directional-control valve 68 may be performed using a linkage 70 connecting the swashplate 20 and a moving slide of the directional-control valve 68.

Figure 2:
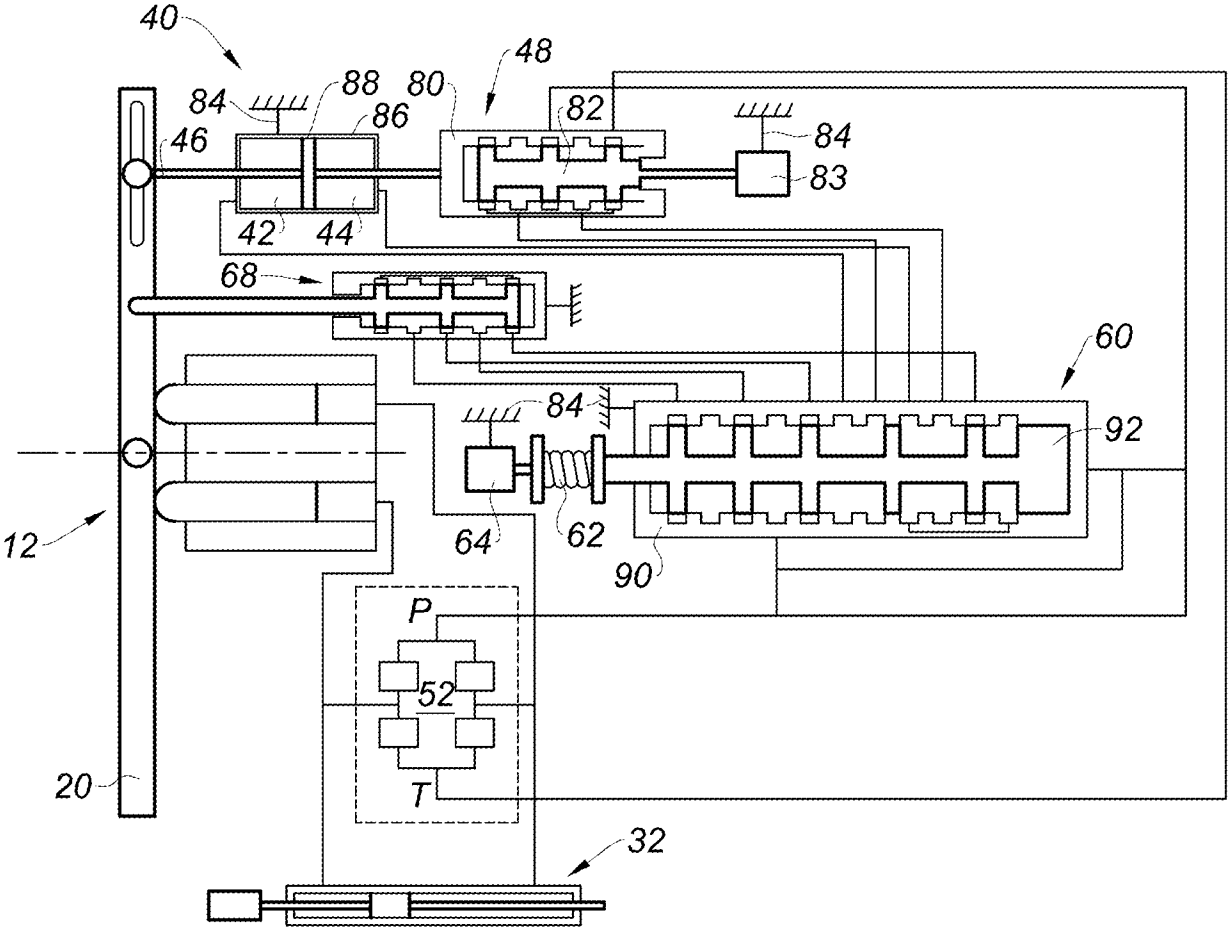
FIG. 2 depicts the actuator of FIG. 1, with the detail of the directional-control valves visible.

FIG. 2 depicts the three directional-control valves 48, 60 and 68 in greater detail. For each of the three directional-control valves, the various positions that define the connections they are able to make are achieved by means of a slide capable of moving inside a body. The movement of the slide opens or closes certain hydraulic circuits as required.

The directional-control value 48 comprises a body 80 and a slide 82 capable of moving in the body 80 under the action of a microactuator 83. The microactuator 83 allows the slide 82 to move with respect to a casing 84 of the actuator 10. In FIG. 2, the slide 82 is depicted in a middle position with respect to the body 80. This position forms the neutral position 48*a* of the directional-control valve 48 and the slide 82 blocks off the hydraulic outlet ducts of the directional-control valve 48 that supply the chambers 42 and 44 of the ram 40. In other words, in normal operation, namely as long as the high pressure P does not reach the pressure limit, the inclination α of the swashplate 20 remains unchanged. When the slide 82 is pushed to the right, the directional-control valve 48 reaches the position 48*b* in which, in normal operation, the chamber 44 is supplied with the high pressure P. Conversely, when the slide 82 is pushed to the left, the directional-control valve 48 reaches the position 48*c* in which, in normal operation, the chamber 42 is supplied with the high pressure P. The positions of the slide valve 82 may be discrete positions. However, advantageously, the slide 82 moves continuously between its three positions. More specifically, by means of the microactuator 83, it is possible to position the slide 82 in an intermediate position somewhere between the neutral position 48*a* and one of the positions 48*b* or 48*c*. In the position 48*b* or 48*c* the directional-control valve 48 fully opens the hydraulic circuit supplying the chambers 42 and 44. In an intermediate position, the directional-control valve only partially opens the hydraulic circuit thus forming a restriction on the supply of the chambers 42 and 44. It is thus possible to control the speed at which the inclination α of the swashplate 20 varies.

Furthermore, the ram 40 comprises a body 86 in which there moves a piston 88 separating the two chambers 42 and 44. The rod 46 is secured to the piston 88. The body 86 is secured to the casing 84.

The body 80 of the directional-control valve 48 may be secured to the casing 84. In normal use, as long as the output pressure of the pump 12 remains below the predetermined pressure limit, it is then necessary to provide two steps in the commanding of the microactuator 83 in order to move the swashplate 20 between two values of inclination α: a first step to transition from the position 48*a*, for example to the position 48*b*, and a second step to return to the position 48*a*.

In order to limit the energy consumption of the microactuator 83, it is desirable to avoid the second step in the commanding of the microactuator 83 by connecting the body 80 of the directional-control valve 48 to the rod 46 of the ram 40. Thus, when the slide 82 is placed in the position 48*b* for example, the two chambers 42 and 44 are supplied and the piston 88 moves. The movement of the piston 88 in turn moves the body of the directional-control valve 48 via the rod 46 until the directional-control valve 48 regains its position 48*a* thereby blocking off the supply to the two chambers 42 and 44. A continuous movement of the slide 82 between its three positions in this case becomes particularly beneficial. Specifically, starting from the neutral position 48*a* and after driving of the microactuator 83 to allow the slide 82 to be moved, one of the chambers 42 and 44 is supplied with high pressure P and the other with low pressure T. The orientation α of the swashplate 20 changes and the rod 46 moves the body 80 until the slide 82 is returned to the neutral position 48*a*. This return to the neutral position 48*a* occurs continuously, coming to a standstill progressively.

The connection between the rod 46 of the ram 40 and the body 80 of the directional-control valve 48 may be an encastre connection. It is also possible to insert, between the rod 46 and the body 80, one or more elements that allow the transmission of movement from the piston 88 to the body 80 to be modified temporarily. Thus it is possible to insert a spring and/or a damper between the rod 46 and the body 80.

The connection between the rod 46 of the ram 40 and the body 80 of the directional-control valve 48 may be performed independently of the fitting of the directional-control valve 60.

The directional-control valve 60 comprises a body 90 and a slide 92 able to move in the body 90 under the action of the pressure P. The movement of the slide 92 allows hydraulic ducts internal to the directional-control valve 60 to be placed in communication or blocked off so as to allow the transition of the directional-control valve 60 between the two positions 60*a* and 60*b*. As long as the pressure P is below the predetermined pressure, the slide 92 is held in the position 60*a* by the spring 62. Conversely, when the pressure P reaches or exceeds the predetermined pressure, the spring 62 is compressed and the slide 92 moves in the body 90 to reach the position 60*b*. The body 90 is secured to the casing 84. The motor 64 can be used to adjust the compression of the spring 62 with respect to the body 90.

Figure 3:
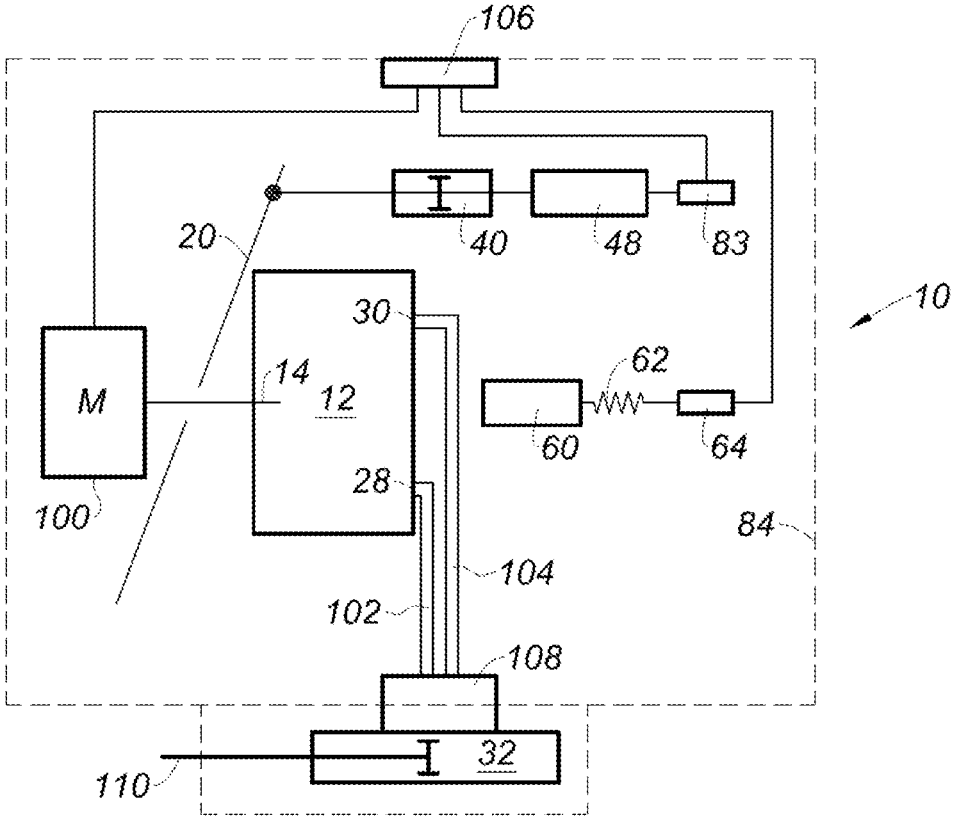
FIG. 3 schematically depicts the main elements of the actuator.

FIG. 3 depicts the main elements of the actuator 10. It again shows the pump 12, the swashplate 20 and the elements for commanding the inclination α thereof: the ram 40, the directional-control valve 48 and its microactuator 83. It also again shows the overpressure limiting device comprising the directional-control valve 60 and the spring 62 and also the device for adjusting the value of the overpressure, comprising the motor 64. The motor that can be used to turn the shaft 14 of the pump 12 appears here with the reference numeral 100. Finally, FIG. 3 again shows the hydraulic-power part of the actuator 10, which part is formed by hydraulic ducts 102 and 104 each coming from one of the outlet orifices, respectively 28 and 30, of the pump 12.

The actuator 10 may receive electrical energy and deliver hydraulic energy. To do that, inside the casing 84 there are at least the motor 100, the pump 12, the swashplate 20, the ram 40, the directional-control valve 48, the microactuator 83 and the directional-control valve 60. At least one electrical connector 106 passing through the casing 84 allows the transmission to the actuator 10 of the electrical energy needed to rotate the pump 12 and a command signal for driving the inclination α of the swashplate 20. When an adjustment of the predetermined position is planned, the electrical connector 106 allows the actuator 10 to receive a command signal for adjusting the predetermined pressure. In practice, the connector 106 may be a single connector or may be split into two connectors, one for the power and the other for the command signal or signals. The actuator 10 may deliver energy in hydraulic form and more precisely in the form of a delivery of fluid. To that end, a hydraulic connector 108, arranged so that it passes through the casing 84, allows energy in hydraulic form to be transmitted to outside the actuator 10.

Alternatively, the actuator 10 receives electrical energy through the connector 106 and delivers mechanical energy through the ram 32 which is positioned inside the casing 84. In other words, the actuator 10 comprises a mechanical output 110 passing through the casing 84 and allowing the actuator 10 to deliver mechanical energy. The mechanical output may adopt various forms, such as, for example, the rod of the ram 32 in the case of a linear ram, the end of a rotary shaft in the case of a rotary ram. The hydraulic ducts 102 and 104 supply the ram 32. It is possible to dispense with the hydraulic connector 108. The ducts 102 and 104 do not open to the outside of the actuator 10. Thus, the actuator 10 has an electrical input and a mechanical output. The hydraulic fluid remains confined inside the casing 84. It is thus possible to replace an actuator based on an electric motor with a actuator according to the invention, making savings in terms of volume and of mass.

The invention claimed is:

1. A hydraulic actuator comprising a variable-delivery positive-displacement pump, a first directional-control valve commanded on the basis of an actuator movement instruction, and a ram supplied by the first directional-control valve, the pump comprising a mobile member a movement of which allows a delivery of the pump to be continuously varied, the member being able to be moved by the ram, the first directional-control valve being able to apply a continuous function linking the movement instruction to the delivery of the pump via the position of the member as it moves, wherein the actuator comprises a second directional-control valve commanded on the basis of an output pressure (P) of the pump, the second directional-control valve comprising two positions, a rest position, obtained as long as the output pressure (P) of the pump is below a predetermined pressure and transmitting the output pressure (P) from the first directional-control valve directly to the double-acting ram, thereby allowing the pump to follow the continuous function and, an active position, obtained when the output pressure (P) of the pump is greater than or equal to the predetermined pressure and transmitting the output pressure (P) of the pump to the ram so as to reduce the output pressure (P) of the pump without passing via the first directional-control valve and without following the continuous function, wherein the member is configured to allow the pump to reverse the direction of its delivery, wherein the ram comprises two chambers and in that the actuator comprises a third directional-control valve configured to transmit the output pressure (P) of the pump either to one or the other of the two chambers according to the direction of the delivery of the pump.

2. The hydraulic actuator as claimed in claim 1, wherein the predetermined pressure is adjustable.

3. The hydraulic actuator as claimed in claim 1, further comprising a set of valves which is configured to command the second directional-control valve by means of a highest output pressure of the pump.

4. The hydraulic actuator as claimed in claim 1, wherein the ram comprises a mobile rod connected to a body of the first directional-control valve.

5. The hydraulic actuator as claimed in claim 4, wherein the mobile rod is connected to the body of the first directional-control valve by means of an encastre connection.

6. The hydraulic actuator as claimed in claim 1, wherein the pump is a piston pump with axial pistons, the member allowing the delivery to be varied being a swashplate with variable inclination ($\alpha$) against which the pistons press, varying the inclination ($\alpha$) of the swashplate allowing a stroke of the pistons to be varied, the inclination ($\alpha$) of the swashplate being adjusted by the ram driven by a microactuator defining the actuator instruction through the first directional-control valve as long as the output pressure (P) of the pump is below the predetermined pressure.

7. The hydraulic actuator as claimed in claim 1, comprising a casing inside which are arranged: the pump, a motor allowing actuation of the pump, the member allowing the delivery of the pump to be continuously varied, the ram actuating the member, the first directional-control valve supplying the ram, a microactuator maneuvering the first directional-control valve and the second directional-control valve, further comprising at least one electrical connector passing through the casing and allowing the actuator to receive electrical energy that powers the motor and an electrical signal which drives the microactuator, and a hydraulic connector passing through the casing and allowing the actuator to deliver hydraulic energy.

8. The hydraulic actuator as claimed in claim 1, comprising a casing inside which are arranged: the pump, a motor allowing actuation of the pump, the member allowing the delivery of the pump to be continuously varied, the ram actuating the member, the first directional-control valve supplying the ram, a microactuator maneuvering the first directional-control valve and the second directional-control valve, further comprising at least one electrical connector passing through the casing and allowing the actuator to receive electrical energy that powers the motor and an electrical signal which drives the microactuator, and a mechanical output passing through the casing and allowing the actuator to deliver mechanical energy.

9. The hydraulic actuator as claimed in claim 7, wherein the predetermined pressure is adjustable, and the at least one electrical connector allows the actuator to receive a second electrical signal to drive the adjustment of the predetermined pressure.

10. The hydraulic actuator as claimed in claim 1, wherein the first directional-control valve comprises a neutral position wherein the member is immobile, not causing the delivery of the pump to vary, and two active positions wherein the member moves, causing the delivery of the pump to vary, and in that the first directional-control valve is configured in such a way that the transition between the neutral position and one of the active positions takes place continuously.

* * * * *